United States Patent [19]

Zundel

[11] 4,202,287

[45] May 13, 1980

[54] METHOD OF ATTACHING TAB TO END PANEL

[75] Inventor: Arthur P. Zundel, Mount Prospect, Ill.

[73] Assignee: National Can Corporation, Chicago, Ill.

[21] Appl. No.: 962,078

[22] Filed: Nov. 20, 1978

Related U.S. Application Data

[60] Division of Ser. No. 873,548, Jan. 30, 1978, Pat. No. 4,148,409, which is a continuation-in-part of Ser. No. 789,096, Apr. 20, 1977, abandoned.

[51] Int. Cl.[2] ..... B21D 51/44

[52] U.S. Cl. ..... 113/121 C; 29/522 A

[58] Field of Search ..... 113/121 R, 121 C; 29/509, 522; 220/267, 268, 273; 53/412, 486

[56] References Cited

U.S. PATENT DOCUMENTS

| | | | |
|---|---|---|---|
| 3,543,391 | 12/1970 | Henchert | 113/121 C |
| 3,704,805 | 12/1972 | Sheafe | 220/273 |
| 3,938,693 | 2/1976 | Patel et al. | 220/268 |
| 3,938,696 | 2/1976 | Herbst | 220/273 |
| 3,986,633 | 10/1976 | Jordan | 220/273 |

*Primary Examiner*—Michael J. Keenan

*Attorney, Agent, or Firm*—Ralph R. Rath; Robert A. Stenzel

[57] ABSTRACT

An easy open ecology end consisting of a removable section defined in an end panel and a tab for severing the removable section is disclosed herein. The removable section or disc is defined by a weakened score line and the tab has an opening edge aligned with at least a part of the inner edge of the score line with the opening edge having primary contact means for producing initial rupture of the score line. The tab is attached to the end using a unique method which will produce internal stresses in the metal of the tab so that the tab is constantly urged toward the surface of the end. The tab also has an opening therein aligned with the removable section and is designed to be locked into the opening created by severing the weakened line.

7 Claims, 13 Drawing Figures

METHOD OF ATTACHING TAB TO END PANEL

REFERENCE TO RELATED APPLICTIONS

This application is a division of U.S. application Ser. No. 873,548, filed Jan. 30, 1978, now U.S. Pat. No. 4,148,409, which is a continuation-in-part of U.S. application Ser. No. 789,096, filed Apr. 20, 1977. entitled "Panel with Opening Means", now abandoned.

BACKGROUND OF THE INVENTION

The present invention relates generally to container ends having non-detachable opening means for removal of the contents and more particularly to an improved tab arrangement for serving the score line as well as an improved method of attaching the tab to the end panel.

Because of the recent emphasis on ecology, the container industry has for years attempted to develop non-detachable substitutes for the familiar "pop-top" type of easy opening end in which the opening structure is completely separated from the container during opening.

The patented prior art is replete with numerous substitutes for the present generally conventional pop-top end such as "button" designs wherein a weakened area defined in the end panel of the container and a major portion if not all of the button is served from the end panel to expose the contents. This type of opening means has not been generally accepted in the industry and the primary reason is believed to result from the fact that during the opening process, the force must be applied directly to the "button" which may cause the user to cut his finger on the sharp edge that is developed by severing the weakened line. Thus, this proposed alternate for the "pop-top" end has not been accepted commercially to any significant extent. Examples of the "button" design are disclosed in U.S. Pat. Nos. 3,227,304; 3,902,627; and 3,938,455.

Another proposed substitute for the present day conventional ends consists of a removable portion that is designed into the end of the container and a tab attached to the container outside the removable section with a nose portion of the tab overlying the removable section so that pivotal movement of the tab will sever the score line. Examples of this type of ecology end are shown in U.S. Pat. Nos. 4,024,981; 3,977,561; and 3,967,752. While this type of end has received some commercial acceptance, the acceptance has been severely limited because of the problems encountered in opening the end. Since the tab structure is offset a substantial distance from the center of the removable section, difficulties have been encountered in completely severing the scored line and moving the removable section a sufficient distance away from the opening created in the end panel to be unobstructed for removal of the contents.

Quite recently a further proposal has been made as a substitute for the "pop-top" end which is disclosed in U.S. Pat. No. 3,807,597. The end disclosed in this patent again was not accepted commercially because difficulties were encountered in completely severing the score line that ultimately produces the opening in the end panel.

Another type of substitute for the familiar "pop-top" can is disclosed in U.S. Pat. Nos. 3,924,777 and 3,949,898. Both of these patents disclose the formation of a well or recess produced in the end panel with a score formed in the base of the well and a special fitment is received in the well and has a lower edge that severs the score and is retained in the recess. However, this type of opener has not been accepted and it is believed that the reason is the special tooling that would be required to make the end.

Thus, while there have been literally dozens of proposed substitutes for the familiar completely severable tear strip with the attached tab, none of the proposed substitutes has received any degree of commercial success because they are either too complicated to operate, too expensive to produce or are unsanitary during use.

SUMMARY OF THE INVENTION

According to the present invention, an improved tab structure has been developed which can be utilized for severing the weakened line defining a removable section of an end panel and is particularly designed to insure that the entire score line is severed with a minimum amount of effort.

According to the primary aspect of this invention, a unique method has been developed for attaching the tab to an area outside the removable disc so that the tab is at all times urged towards the adjacent surface of the end panel. According to this method, the tab is attached to the end panel through an integral rivet arrangement and the connecting tongue between the tab and the rivet is stressed in such a manner that the entire tab is urged towards the surface of the container.

In one version of the invention, a circular opening is formed in the tab that corresponds generally to but is slightly smaller than the opening created by severing the removable section. In this version of the invention, an inwardly directed flange extends from the periphery toward the removable disc and is aligned with the inner edge of the weakened line throughout the length thereof.

The inwardly directed flange has a single or primary contact area on the free edge and the contact area is located adjacent the periphery of the end panel while the tab is connected to the center panel by an integral rivet that is located between the center of the panel and the adjacent edge of the removable section or disc. The connecting end or tongue is stressed, i.e. the metal is placed in compression, so that the tab, particularly the free end with the contact area, will always be urged toward the outer surface of the end panel.

In another version of the present invention, the opening tab or member is permanently connected to the end panel or closure outside the weakened score line and has a peripheral portion located outside the weakened score line with an opening in the tab located within the confines of the opening created by severing the weakened line. The tab body has an inwardly turned edge or flange extending from the non-circular opening therein towards the removable section or disc with the free edge having at least one point aligned with the inner edge of the weakened line and two other points aligned with an area spaced inwardly from the weakened line to define the primary and secondary contact areas between the disc and the tab or opening member.

In all versions of the invention, the disc or removable section is preferably circular and has a circular blister or raised portion which is located within the opening in the tab. In one version, the blister has a raised portion offset from the center of the removable disc toward the primary contact area to assist in propogation of the score line after initial rupture by the primary contact area.

The tab also has locking means for automatically locking the tab into the opening created by severing the weakened line. It has been found that the stresses developed in the metal for the end panel produced by being attached to a pressurized container will align the locking means with the inner edge of the weakened score line. However, when the score line is initially ruptured, this stress will be relieved and the tab will shift with respect to the end panel to have the locking means located under the edge of the opening created in the panel.

In all versions of the invention, the stress developed in the metal of the tab substantially eliminates the possibility of the tab being removed from the panel. This is particularly true after the removable disc has been severed because the tab is locked into the opening.

The arrangement allows for the use of conventional tooling, with some modifications, so that the tab can be made at approximately the same cost as tabs that are now used with "pop-top" ends.

DETAILED DESCRIPTION

Figure 1:
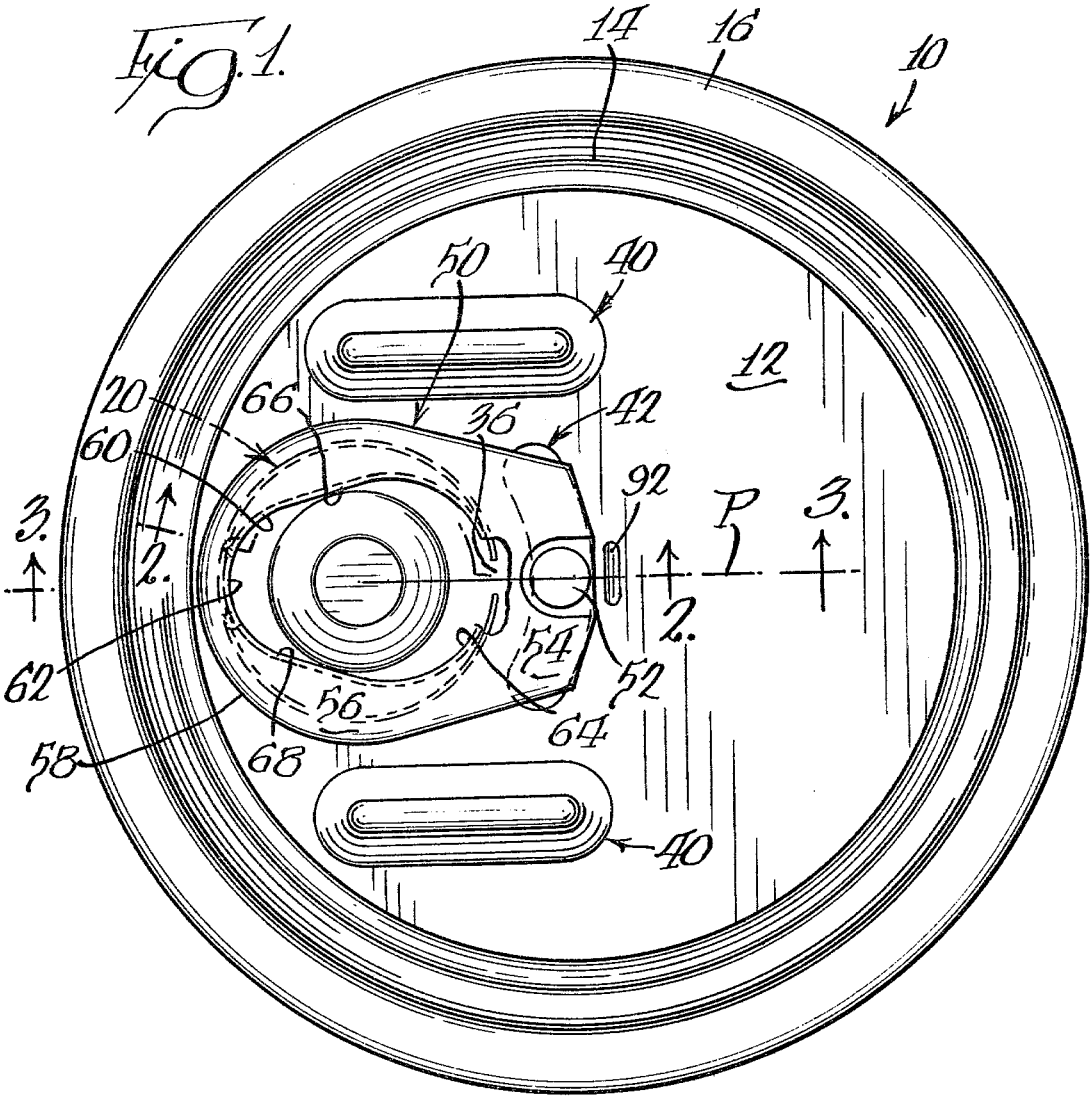
FIG. 1 illustrated a plan view of an end closure having an opening tab of the present invention attached thereto.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings shows an end panel, generally designated by reference numeral 10, which has an opening means, to be described later, that remains permanently attached to the end panel to produce an ecology end. Ecology end 10 consists of a substantially flat central portion 12, a countersink or trough 14 surrounding the circular flat central portion 12. A peripheral rim or flange 16 is located outside the inwardly directed trough 14 with the peripheral rim or flange adapted to be seamed to the end of a container in a manner well known in the art.

Flat central or circular panel 12 has a removable section defined therein that is capable of being severed along a major portion of the periphery thereof while still being permanently retained on the end wall of the panel. For this purpose, the peripheral portion has a weakened line 20 defined therein which is produced in the manner disclosed in the above mentioned copending application, the portions of which are consistent with the present disclosure being incorporated herein by reference.

Figure 7:
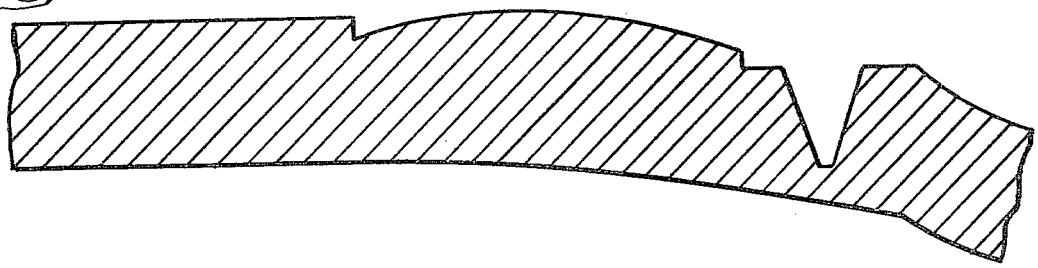
FIG. 7 is an enlarged fragmentary sectional view of the area that defines the removable section and the end panel.

In other words, weakened line 20 (FIG. 7) is formed in a three step process as described and claimed in the above mentioned application in which the first step includes coining an inner substantially closed area 24 to reduce the thickness of the metal in the coined area which may either be located on the outer surface of end panel 12 or on the inner surface thereof. The second step is to form a substantially closed second flat annular reduced portion or coin 26 located outside the inner or first annular reduced portion 24 and then producing a score 28 that defines a tear portion 30 inside the inner coined area 24. The score, therefore, defines a removable section or substantially circular disc 30 and substantially all of the metal that is displaced during the production of inner and outer coined areas 24 and 26 as well as score 28 flows generally into removable disc or severable member 30 so that the disc is substantially concave in cross section while the annular area between the inner and outer coins 24 and 26 is inclined slightly with respect to the horizontal plane of flat circular portion 12, as is explained more fully in the above-mentioned application.

Figure 3:
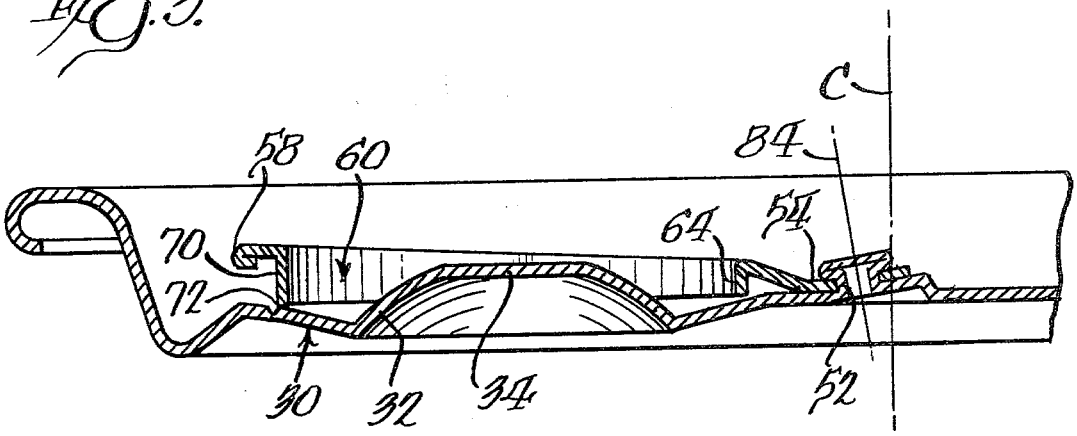
FIG. 3 is a sectional view as viewed along line 3—3 of FIG. 1.

During this coining and scoring operation, the generally concave removable disc or opening flap 30 (FIG. 3) has a blister or raised portion 32 produced in the center thereof and the center of the blister or raised portion is flattened as illustrated at 34 in FIG. 3 for a purpose that will be described later. Also, weakened line 20, particularly score line 28, has opposite ends spaced from each other to produce an uninterrupted portion 36 (FIG. 1) which is located generally along a plane extending through the center of central panel 12 and the center of removable disc 30, for a purpose that will be described later. The unsevered portion 36 defines a permanent connection between the removable disc or tear portion 30 and the remainder of flat end panel 12. The central blister or raised portion 32 is preferably formed in the same manner as the initial formation of a blister which ultimately is reformed into the rivet as disclosed in the above-mentioned application.

Central flat circular panel 12 also has reinforcing means consisting of first and second parallel reinforcing members 40 and arcuate reinforcing member 42 which are produced in the manner described in the above referenced application and a further detailed description thereof does not appear to be necessary at this point.

According to the present invention, a tab or opening member 50 is permanently attached to flat central panel portion 12 through a permanent connection or integral rivet 52. The details of the connection will be described more fully hereinafter. Tab 50 consists of a body portion 56 that has a tongue or connecting end 54 connected to rivet 52 and extends entirely across circular disc 30 while its peripheral edge 58 is located outside weakened score line 20, for a purpose that will be described later. Tab 50 also has an opening 60 defined therein and opening 60 is non-circular with its entire periphery located within the confines of removable disc 30, as will be explained more fully later. More specifically, opening 60 is generally oval or teardrop in shape and has its center located on the center of removable disc 30 while opposite end portions 62 and 64 are respectively generally vertically aligned with the inner edge of weakened score line 20 along the plane P extending through the center of central panel 12 and the center of removable disc 30. The intermediate portions 66 and 68 of opening 60 extend generally chordally between opposed locations defined by the circular score line 20 so that the intermediate portions are spaced inwardly a substantial distance from score line 20 which defines removable section 30.

Figure 2:
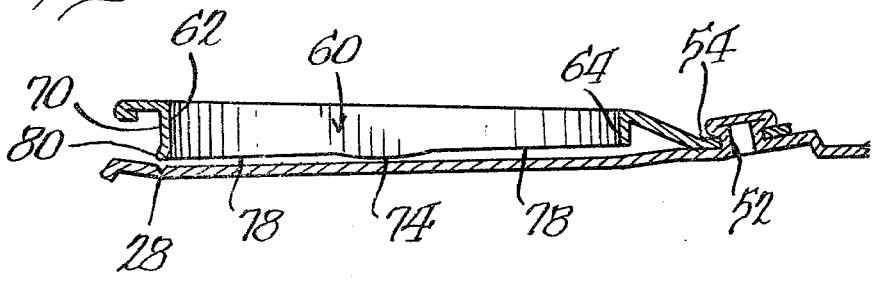
FIG. 2 is an enlarged fragmentary sectional view as viewed generally along line 2—2 of FIG. 1 showing the configuration of the tab engaging means.

According to one aspect of the present invention, tab body 56 has an integral flange 70 which is integral with the edge of opening 60 and extends generally perpendicular to the body thereof. Integral flange 70 thus produces an in-turned area or downwardly projecting portion, at least a part of which is aligned with the inner edge of the weakened line, as shown in FIG. 3. The free end of downwardly projecting portion or flange 70 has an irregular contour which defines primary and secondary contact means for engaging the removable disc or tear portion of flat central panel 12. More specifically, as illustrated in FIG. 2, the lower free edge of flange 70 has an irregular shape which may be described as being a generally sinusoidal configuration to produce a plurality of low points 72 and 74 which are interconnected by generally flat high portions 78.

According to one aspect of the invention, the first low point 72 defines a primary contact area between disc 30 at a location which is in closest proximity to the periphery of flat central circular portion 12 of end panel 10. The first low point 72 defines a primary contact means which is aligned with the inner edge of weakened score line 20. In addition, the two spaced low points 74 located intermediate opposite ends of non-circular flange 70 (only one of which is shown) are located generally along a plane that extends through the center of blister 32 and disc 30 and perpendicular to plane P extending through the center of flat panel 12 and the center of disc 30. This pair of low points 74 define secondary contact means which are spaced inwardly of the weakened line 20 and are preferably initially spaced from the surface of disc 30 as illustrated in FIG. 2. If desired, a further low point (not shown) may be aligned with area 36 but it has been found that such low point or contact area is not necessary.

Figure 4:
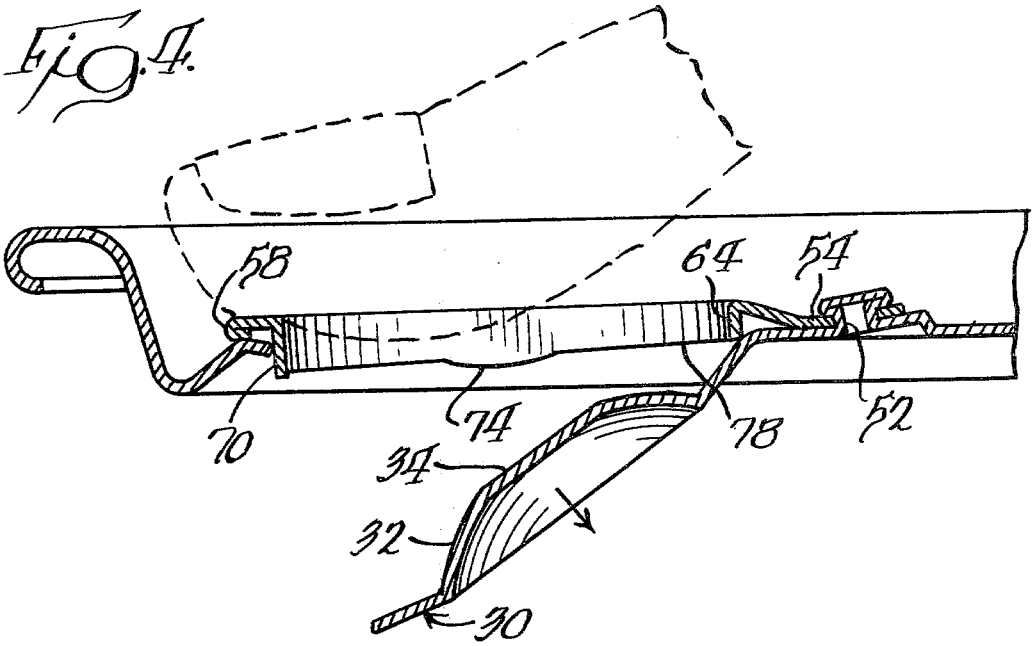
FIG. 4 is a view similar to FIG. 3 showing the manner in which the weakened score line is severed.

With the tab so far described, initial pressure applied to the top surface or body of tab 50 by the thumb of a consumer, as illustrated in FIG. 4 will produce a downwardly directed force on removable disc 30 and this downwardly directed force will initially be applied to a localized area of the removable disc which is located adjacent the periphery of panel 12 to produce an initial rupture of the weakened area by the first low point or projection that defines the primary contact means between the tab and the removable disc. Preferably the weakened area has a portion of minimum thickness below primary contact area 72.

At the same time pressure is being applied to the top surface of the tab body 56, pressure will also be applied to the center flat portion 34 of disc 30 so that, after initial rupture of the forward portion of the score line, the rupture will be propagated all around the entire weakened line to the spaced points that define the uninterrupted portion 36. This propagation or continuation of the rupture of the weakened line is further assisted by the fact that the secondary contact means 74 ultimately engage the upper surface of the removable disc at a location spaced inwardly from the weakened score line, preferably in the area just directly outside the juncture between the blister 32 and the remainder of the disc 30. It has been found that the secondary contact means or engaging means engaging the removable disc or opening flap 30 ensures that the entire weakened score line 20 will be severed in one continuous motion without any undue manipulation of the thumb of the consumer.

As the final portion of the weakened score line 20 is ruptured, the rearward edge of flange 70 will engage the removable disc 30 adjacent the permanent connection 36 to ensure that the entire disc is moved to a position which is substantially perpendicular to the plane of the central flat panel portion 12.

In the final position for tab 50, the lower free edge of flange 70 is located below the upper surface of flat central panel 12 as illustrated more clearly in FIG. 4.

According to one aspect of the invention, the flange 70 also has lock means for locking the opening member or tab into the aperture defined by severing the removable disc 30 from the remainder of the panel. As more clearly illustrated in FIG. 2, the lock means consists of a plurality of outwardly directed projections 80 which are integral with flange 70 and are positioned at selected locations so as to be forced over the severed edge defined by severing weakened line 20 and to deflect outwardly of the severed edge when the tab is in its final position illustrated in FIG. 4. Preferably, these outwardly directed portions 80 are located at spaced points on opposite sides of lowermost point or projection 72. The outwardly inclined portions 80 are formed so that there initially is only a slight interference between the movement of the projections 80 over the severed edge so as not to impede the rupture of the weakened line during the downwardly directed pressure that is applied to the tab. However, as the tab is moved from the position illustrated in FIG. 3 to that shown in FIG. 4, the end portion 62 of the opening will have a tendency to move toward the edge defined by rupturing score line 28, as will be explained later, to aid in this locking feature.

While spaced projections have been illustrated as producing the lock means, in some instances, it may be desirable to have the entire nose portion or end portion of flange 70 located adjacent end 62 deflected outwardly slightly so as to define the lock means. This feature will be described in more detail later.

As can be appreciated from the above description, when the tab and tear portion or disc are in their open position generally illustrated in FIG. 4, the entire peripheral edge or cut edge of the aperture produced by severing weakened line 20 will be completely covered by the downwardly directed flange 70 and will thereby prevent the consumer from cutting his lips or other parts of the body during consumption of the product. Furthermore, since the severed edge is never exposed, it is virtually impossible for the person opening the end panel to be subjected to the exposed cut edge of weakened line 20 during the opening process. This particular feature is extremely important in producing a satisfactory end that will be commercially acceptable for the consumer.

According to another aspect of the invention, the permanent connection or rivet 52 is positioned in such a fashion and is transformed in a manner that the tab inherently has urging means incorporated therein for urging the opening member or tab towards the removable disc or opening flap 30 at all times. As more clearly illustrated in FIG. 3, the center of permanent connection 52 or rivet 52 is offset from the center C for circular flat panel 12 and is located between this center C and the adjacnt edge of circular weakened line 20, more specifically the uninterrupted portion 36. It has been found that this particular arrangement aids in maintaining the body of the tab in close proximity to the surface of end panel 12 at all times.

It will be appreciated that when the container having end 10 secured thereto is pressurized, the weakest area of the container will be the center portion and, upon pressurization, the entire panel will tend to bulge with the maximum movement occurring directly on the center of the panel. If the tab connecting means or rivet 52 is located directly on the center C of the end, the tab will likewise tend to move perpendicular to a plane extending through the main body of flat central panel 12. This in turn would also cause the entire tab to be moved perpendicular to such plane. By having the tab offset from the center C of central flat panel 12, any distortion or bulging of the center of the flat panel will have a tendency of causing the tab to move towards the adjacent surface of flat panel 12.

Figure 5:
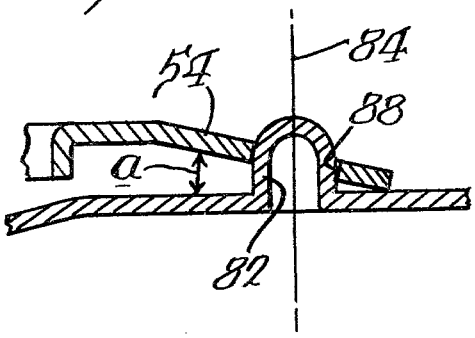
FIG. 5 is an enlarged fragmentary view showing the initial step of attaching the tab to the end panel.

To further insure that the tab at all times remains in contacting engagement with the adjacent surface of the end, particularly central flat circular panel portion 12, the connection of the tab to the panel is produced in such a fashion so as to induce internal stresses into the tab, particularly adjacent the connection means which will tend to urge the entire tab towards the adjacent surface of the end. This is accomplished in a unique fashion that can readily be incorporated into existing equipment with a minimum modification thereof. Thus, as illustrated in FIG. 5, the permanent connection means is formed by initially producing a hollow rivet 82 integral with the end closure with the axis 84 of the hollow rivet extending perpendicular to a plane which extends through the main body of flat panel 12. The tab connecting portion or tongue 54 of the tab, which has an opening 88 for receiving hollow rivet 82, is then inserted onto the hollow rivet 82 with the opening 88 surrounding the rivet. It should be noted that the tongue portion or connection end 54 is initially inclined by a small acute angle (a) with respect to the main body of tab 50 and also inclined generally the same angle with respect to a plane extending through the main body of the flat central panel portion 12.

The next step in the attachment of the metal tab to the metal end closure consists of deforming the hollow rivet 82 to produce a flat portion 90 thereby permanently connecting the tab to end panel 12. During this formation of head 90, the inclined tongue portion 54 is flattened, particularly around the area of hollow rivet 82 and thereby places the tongue portion under a certain compression stress which therefore automatically interjects urging means into the opening member or tab for urging the entire tab towards the surface of the end panel portion 12.

Figure 6:
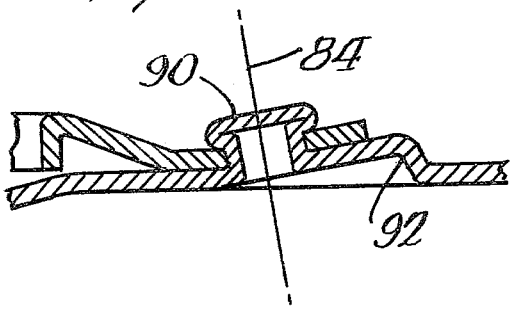
FIG. 6 is a view similar to FIG. 5 showing the final configuration of the tab and connection means.

To further ensure that the tab at all times remains or is urged towards the surface of the central front panel portion 12, at least a portion of the end closure around the rivet is reformed to further stress the metal in the connecting tongue or end and further cause the tab to be urged towards an adjacent surface of the end closure. This step is illustrated in FIG. 6 wherein the axis 84 of hollow rivet 82 has been tilted slightly towards the tab to produce a small acute angle with respect to a plane that extends perpendicular to the main body of flat panel portion 12. This reforming step may be accomplished in several different forms and only an illustrated embodiment has been shown. In the embodiment shown, the reorientation of the rivet and reforming of the area of the central panel 12 around the rivet is produced by forming a small indentation 92 adjacent the area of the rivet located on the side opposite the side of tab 50 so that the rivet and a small area of the central flat panel portion 12 surrounding the rivet as well as the area of the tongue portion or connecting end 54 around the rivet are reoriented to a small angular position illustrated in FIG. 6. In other words, the area of the tongue portion and the central panel around the rivet are inclined with respect to the main body of central panel 12.

This unique arrangement has been found to eliminate virtually any possibility of the tab moving away from the end during packaging, transportation, or storage. Furthermore, the stresses that are developed in the tongue portion of the tab will tend to prevent the consumer from attempting to pull the tab away from the flat central portion 12 and ultimately sever the tab from the remainder of the end closure.

Also, the compressive forces in the tongue portion will tend to urge and retain flange 70 in the opening formed by severing the removable disc.

Summarizing the present invention, the primary contact means between the tab and the removable section or disc produces initial rupture of the weakened score line when an opening force is directed to the outer surface of the tab and conintued pressure on the surface of the tab as well as the blister will produce engagement between the secondary contact means and the tear portion or disc to completely sever or rupture the weakened line and define an opening for removal of the contents from the container.

Also, the permanent stresses that are developed in connecting tongue portion of the tab and the location of the rivet offset from the center of the panel towards the removable disc insures that the lower edge of flange 70 particularly projection 72 remains in engagement with the removable disc 30 even when pressure is applied to the inner surface of the panel.

A modified form of the invention is illustrated in FIGS. 8–13. In this version of the invention, an end closure 110, a generally flat central panel 120 has a weakened score line 122 produced in the manner described above to define a removable section 124.

The end panel or closure also has a countersink or trough 126 around the periphery of flat central panel 120 and a peripheral flange 128 outside countersink 126 and flange 128 is adapted to be seamed to an end of a container (not shown).

A tab 130 is permanently connected to central panel 120 through an integral rivet 132. Tab 130 includes a main body 134 which has an opening 136 in the center thereof that is concentric with the periphery of circular removable disc 124 and has a flange 138 extending from the periphery of opening 136 towards the removable section. Tab 130 also has a second flange 140 extending perpendicular to the main body 134 from the peripheral edge of the tab towards panel 120 and flange 140 is located outside of weakened line 122.

Tab 130 has a connecting end or tongue portion 142 forming a part of main body 134 adjacent one end thereof. Connecting end or tongue 142 has a flat offset portion 144 which has an opening 146 for receiving integral rivet 132. As explained in more detail above, the tab is again attached in the manner described in connection with FIGS. 5 and 6 to produce internal stresses in the connecting end 142, particularly the area between the offset portion 144 and the adjacent portion of flange 138.

Figure 8:
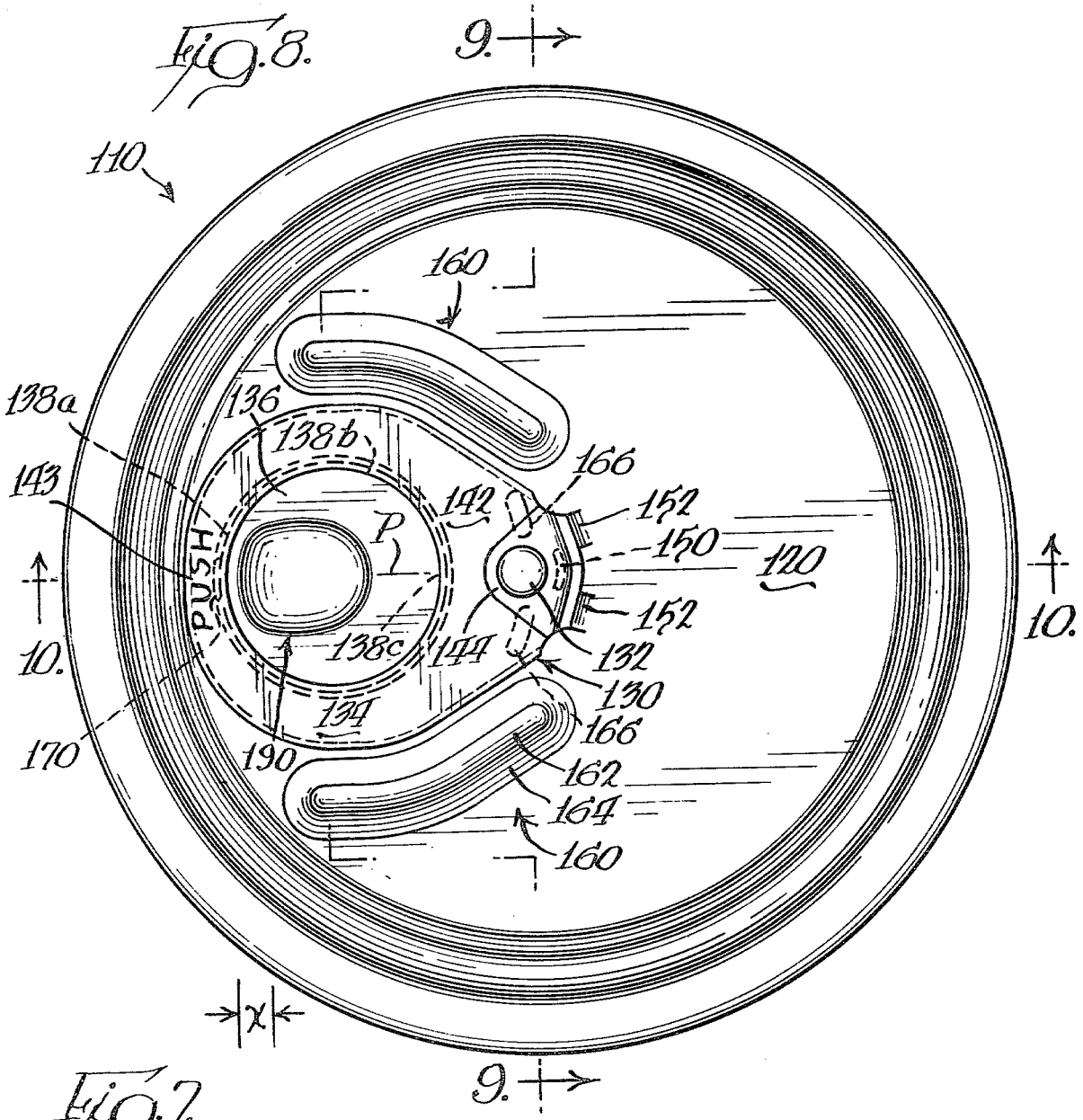
FIG. 8 is a view similar to FIG. 1 showing a modified form of tab.
Figures 9, 10, 11, 12, 13:
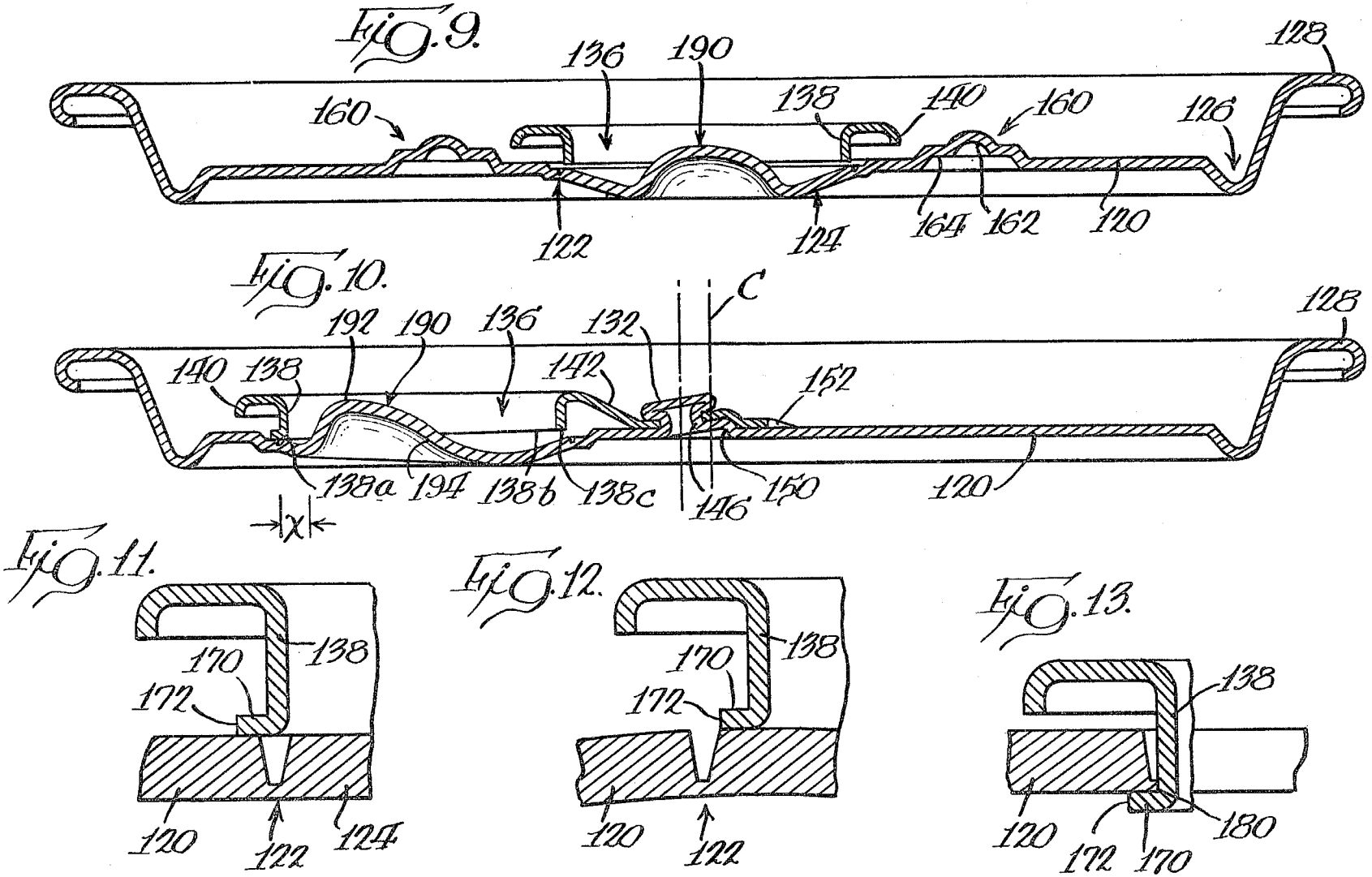
FIG. 9 is a cross-sectional view viewed along line 9—9 of FIG. 8.
FIG. 10 is a cross-sectional view as viewed along line 10—10 of FIG. 8.
FIG. 11 is an enlarged fragmentary view of the relative positions of the weakened line and the locking means before the end panel is attached to a container.
FIG. 12 is a view similar to FIG. 11 of the weakened line and locking means when the end is attached to a pressurized container.
FIG. 13 is a view similar to FIG. 12 showing the position of the locking means after the weakened line has been severed.

In this version of the invention, the reorientation of rivet 132 to the angular position illustrated in FIG. 10 is accomplished by producing an arcuate upwardly directed indentation 150 in the area of the central panel 120 below offset portion 144. Simultaneous to the reformation of the area of central panel 120 around rivet 132, particularly in the area in close proximity to the center of the panel, offset portion 144 is also reformed to conform to the configuration of indentation 150, as illustrated in FIG. 10. This particular feature is advantageous in that it securely locks the tab in a fixed position with respect to removable section 124 and prevents rotation of the tab about the axis of rivet 132. If desired, further antirotation means may be formed in central panel 122. Thus, as illustrated in FIGS. 8 and 10, a pair of beads 152 are deformed from panel 120 adjacent the free edge of offset portion 144 to provide additional antirotation means for tab 130 about the axis of rivet 132.

Central panel 120 again has reinforcing means for reinforcing the areas around weakened score line 122. As illustrated in FIGS. 8 and 9, first and second reinforcing members 160, which are of substantially identical configuration, are located on opposite sides of tab 130 and extend from adjacent the periphery of central panel 120 to an area in close proximity to integral rivet 132. Reinforcing members 160 conform generally to the periphery of the tab on opposite sides thereof intermediate the nose end or free end 143 and the connecting end 142.

Reinforcing members 160 have been illustrated as being in the form of primary beads 162 that extend upwardly above the plane of panel 120 and secondary beads or reinforcing members 164 extending around primary beads 162. Thus, the reinforcing members 160 cooperate with the countersink adjacent the periphery of central panel 120 to produce a rigid structure surrounding the major portion of removable section 124.

In order to further increase the rigidity of the area surrounding removable section or slug 124, it is preferable that additional beads 166 be located on opposite sides of integral rivet 132 in the areas between the ends of primary reinforcing means 160 and the periphery of integral rivet 132. Preferably these beads 166 are directed away from the tab towards the inside surface of central panel 120 so as not to interfere with the connection of the tab to the central panel. Of course, indentation 150 and beads 152 also form part of the reinforcing means for panel 120 outside of weakened line 122.

The lower free edge of flange 138 again has a primary contact area for producing an initial rupture of weakened score line 122 and this primary contact area is defined by having the lower free edge of the flange 138 flat in the area **138*a* adjacent the nose portion 143 of the tab and in opposite directions of plane P extending through the center of the tab and the center of rivet 132. In other words, the free edge 138*a* of flange 138 in the area identified by reference numeral x in FIG. 8 extends generally parallel to a plane extending through the main body of central panel 120. The remainder of the lower free edge 138*b* is tapered slightly away from the adjacent or outer surface of panel 120 so that the highest point or the point of greatest spacing is located at 138*c* in close proximity to permanent connection 132**.

According to another aspect of the invention, flange 138 has lock means defined thereon for permanently locking the tab into the aperture created by severing weakened line 122. In the form of the invention illustrated in FIGS. 8 through 13, this lock means also performs a unique function of providing an interference between the tab 130 an end panel 120 to partially obstruct severing of the weakened line 122 before the end panel or closure is attached to a pressurized container.

As illustrated in FIGS. 8 and 11, the lower free edge of flange 138, in the flattened area portion **138*a*, has an outwardly directed portion 170 which extends generally parallel to a plane extending through the main body of central panel 120 with the free end portion 172 of outwardly directed portion 170 directed away from the connecting end of tab 130. Outwardly directed portion 170 is located in the nose portion 143 of flange 138 and initially is positioned with respect to weakened score line 122, as illustrated in FIG. 11 wherein the outer free edge 172 of portion 170 is located outside the inner edge of weakened line 122. It has been found that if the tab is connected to panel 120 so that the outwardly directed portion 170 is initially positioned as illustrated in FIG. 11, before the end closure is attached to a container, the outwardly directed portion 170 will tend to assist in preventing the weakened score line 122 from being prematurely severed while the end closure is being transported and handled prior to permanent attachment to the end of a container body. However, when the end closure is permanently attached to a container having pressurized contents, there will be a relative shifting of tab 130 with respect to removable section 124 so that the free end portion 172 of locking means 170 will be positioned inwardly of the weakened line as illustrated in FIG. 12. The exact position of locking means 170 with respect to weakened line in FIGS. 11 and 12** is not known and the two positions shown are for purposes of illustration of the concept rather than exact position.

While this phenomenon is not completely understood, it is believed that the shifting of the tab with respect to weakened line 122 in the area adjacent countersink or trough around the perimeter of central panel 120 results from internal stresses that are developed in the main panel 120 from the pressure of the contents in the container after the closure has been attached and sealed to the container. Stated another way, it is believed that the metal in the end closure along the plane p between locking means 170 and integral rivet 132 is stretched sufficiently so that the free end 172 of locking means 170 moves away from the perimeter of central panel 120 to be aligned, as illustrated in FIG. 12.

It has also been determined that after initial rupture of the weakened score line by primary contact area **138*a*, the stresses developed in the main body of central panel 120, resulting from the pressure inside of the container, will be relieved and locking means 170 will therefore be positioned under central panel 120 outside the severed edge 180 which produces the opening or aperture for removal of the contents. While this phenomenon has been illustrated and described in connection with the end and tab illustrated specifically in FIG. 8, it is also believed that the same phenomenon occurs in the embodiment illustrated in FIG. 1**.

Central panel 120 illustrated in FIG. 8 also has a blister or raised portion 190 defined in opening flap or removable section 124. In this embodiment, raised portion or blister 190 is configured in such a fashion to assist in severing the weakened line after initial rupture of the score line by the primary contact means 138*a*. As illustrated in FIGS. 8 and 10, raised portion or blister 190 has a portion 192 of maximum height located in an area between the center of removable section 124 and the adjacent portion of tab 130 which has the primary contact area 138 defined thereon. The remainder of blister or raised portion 190 tapers downwardly generally along a plane 194 and merges with the periphery of removable section 124 in an area between the center of removable section 124 and the area of the tab having connecting end 142 thereon. It has been found that having the point of maximum height 192 of blister 190 located in close proximity to the primary contact area 138*a* of flange 138 will allow the entire weakened line 122 to be severed, except for the permanent connection, without undue manipulation of the thumb of a person opening a container to which the end closure is attached.

The opening of end closure 110 is performed generally in the same manner as the previous embodiment. A consumer places his thumb on the nose portion 143 of tab 130 in the area identified by the term "PUSH" in FIG. 8. At the same time a central part of the thumb engages the raised portion 192 of blister 190 which is in close proximity to nose portion 143.

A downward pressure by the thumb will initially cause primary contact area 138*a* to produce an initial rupture of score line 122 adjacent the perimeter of central panel 120. This initial rupture is assisted by forces that are applied to raised portion 192 adjacent the periphery of removable section 124 in an area remote from connecting means 132. Continued pressure by the thumb of a consumer will continue rupture of the score line, except for the permanent connection (not shown), and the removable section or disc will be bent at the permanent connection to extend substantially perpendicular to center panel 120 to produce an unobstructed aperture for removal of the contents.

It should also be pointed out that when score line 122 is initially ruptured by primary contact area 138*a*, locking means 170 will be forced below the inner surface of severed edge 180 and the pressure inside the container will simultaneously be vented so that the stresses in central panel 120 will be relieved. Therefore, locking means 170 will automatically be moved to the position illustrated in FIG. 13.

While in the embodiment of the invention illustrated in FIG. 1, the removable section or disc 30 has been illustrated as being permanently attached by an unscored area, it will be appreciated that the permanent connection could also be produced by a partially scored area. In some instances it may be desirable to have scoring of different thickness to produce different residuals in different areas of the weakened line which define a permanent connection between removable section 124 or 30. This may be desirable in certain instances to assist in producing a bending action in the permanently connected area of the removable disc to assure that the removable disc is moved away from the aperture created by severing the weakened line a sufficient distance to provide unobstructed removal of the contents from the container. Furthermore, the permanent connection need not be located along plane p but could be offset circumferentially on either side.

In both embodiments of the invention, the combined features of having the tab locked into the pour opening and urged toward the outer surface of the central panel after the weakened line has been severed makes it almost impossible to remove the tab from the end panel to create a liter problem. Also, in both embodiments, particularly the embodiment of FIG. 8, the tab can be formed with only a minimum modification of existing tab die tooling. More specifically, in forming present commercial tabs for a "pop-top" end, the tab is formed from a flat blank metal stock and usually has the outer periphery folded under the main body and a flange integral with the inner edge of the opening that defines the gripping portion of the tab also folded under the main body. Thus, it is only necessary to configure the opening in the tab to conform to the removable section and bend a flange perpendicular to the main body with one or more projections on the free edge of the flange.

In some instances, it may be desirable to increase the flexibility of the tab so that it can be moved axially of the axis of the pour opening. This can be accomplished by removing selected portions of the connection end or tongue on opposite sides of the integral rivet so that the tab is not restricted to movement along an arcuate path which has its center at the rivet.

From the above description, it will be apparent that an ecology end has been developed which meets all ecological requirements and can still be manufactured at a cost competitive to the cost for present commercial completely removable tear strip ends. The ecology end does not require any special sealants or plastisols for the weakened area and can still be opened with minimum pressure due to the unique configuration of the score area and the manner in which the movable section is formed. Furthermore, the end can be produced with minor modification of existing lane tooling which can be modified at minimum cost.

I claim:

1. A method of attaching a metal tab with a connecting end having an opening to a metal end closure, said metal end closure having a weakened line located below said metal tab to define a substantially circular removable section and said tab having a flange extending from the periphery of the opening toward the removable section and located inside the weakened line, said flange having an outwardly directed portion on a free edge thereof directed away from said connecting end at a location remote from said connecting end, comprising the steps forming a hollow rivet in said end closure, positioning the said tab on said end closure with said opening surrounding said hollow rivet, deforming said hollow rivet to permanently secure said tab to said end closure and locate said outwardly directed portion outside an inner edge of said weakened line, reforming at least a portion of said end closure adjacent said rivet to stress the metal in said connecting end to cause said tab to be urged toward an adjacent surface of said end closure, and attaching the end closure to a container having pressurized contents so that said outer end of said outwardly directed portion is moved inside the inner edge of said weakened line.

2. A method of attaching a metal tab with a main body having a flange extending perpendicular therefrom and a connecting end to a metal end closure having a weakened line defining a removable section, comprising the steps of forming a hollow rivet in said end closure outside said weakened line, positioning said connecting end over said rivet and deforming said hollow rivet to permanently secure said tab to said end closure with said main body overlying said removable section and said flange having a portion remote from said connecting end outside an inner edge of said weakened line, and attaching the end closure to a container having pressurized contents to cause said portion of said flange to be moved inside said weakened line.

3. A method as defined in claim 2, in which said connecting end is initially inclined by a small acute angle with respect to said main body before being positioned over said hollow rivet and at least a portion of said connecting end is flattened during said deforming step to urge said main body toward said removable section.

4. A method as defined in claim 3, in which said hollow rivet is initially formed with its axis extending parallel to an axis extending perpendicular through the center of said panel, including the further step of reforming at least a portion of said end closure adjacent said rivet after said deforming step to tilt the axis of said rivet with respect to the axis through said center and urge said main body toward said removable section.

5. A method as defined in claim 4, in which a portion of said connecting end is also reformed during said reforming step.

6. A method of attaching a metal tab with the main body and a connecting end having an opening to a circular metal end closure having a score line defining a removable section between the center and periphery of said closure, comprising the steps of forming a hollow rivet in said end closure between said center and said removable section with said rivet having an axis extending perpendicular to a plane extending through said end closure and parallel to an axis extending through the center of said closure, positioning said tab on said end closure with said opening surrounding said hollow rivet and said main body overlying said removable section, deforming said hollow rivet to permanently secure said tab to said end closure, and reforming at least a portion of said end closure adjacent said rivet to tilt the axis of said rivet toward said removable section and produce a small acute angle betweeen the axis of said rivet and the axis through said center so that said main body is urged toward said removable section.

7. A method as defined in claim 6, in which said connecting end is initially inclined by a small acute angle with respect to said main body and a plane extending through said end closure and a portion of said connecting end is reformed during said reforming step to urge said main body toward said removable section.

* * * * *